US007293306B2

(12) United States Patent
Hermanczuk

(10) Patent No.: US 7,293,306 B2
(45) Date of Patent: Nov. 13, 2007

(54) FITTED TOP SHEET

(75) Inventor: Anna Hermanczuk, 2525 Bretby, Troy, MI (US) 48098

(73) Assignees: Christine Hermanczuk Lucas, Troy, MI (US); Anna Hermanczuk, Troy, MI (US)

( * ) Notice: Subject to any disclaimer, the term of this patent is extended or adjusted under 35 U.S.C. 154(b) by 211 days.

(21) Appl. No.: 11/127,996

(22) Filed: May 12, 2005

(65) Prior Publication Data

US 2006/0253981 A1 Nov. 16, 2006

(51) Int. Cl.
*A47G 9/02* (2006.01)

(52) U.S. Cl. ..... 5/497; 5/499; 5/482

(58) Field of Classification Search ..... 5/497, 5/495, 499, 485, 482
See application file for complete search history.

(56) References Cited

U.S. PATENT DOCUMENTS

| | | | | | |
|---|---|---|---|---|---|
| 1,190,266 | A | * | 7/1916 | Crooker | 4/621 |
| 2,972,756 | A | * | 2/1961 | Monier et al. | 5/496 |
| 3,056,245 | A | * | 10/1962 | Baum et al. | 53/436 |
| 3,273,175 | A | | 9/1966 | Anderson et al. | 5/497 |
| 3,321,782 | A | * | 5/1967 | Hrubecky et al. | 5/487 |
| 3,638,252 | A | * | 2/1972 | Palenske | 5/497 |
| 3,681,795 | A | * | 8/1972 | Palenske et al. | 5/497 |
| 3,739,408 | A | * | 6/1973 | Pagels | 5/496 |
| 3,868,735 | A | | 3/1975 | Ross | 5/497 |
| 4,095,300 | A | * | 6/1978 | Ruben | 5/502 |
| 4,308,626 | A | | 1/1982 | Weiss | 5/485 |
| 4,422,195 | A | * | 12/1983 | Russo et al. | 5/497 |
| 4,651,371 | A | * | 3/1987 | Hahn | 5/497 |
| 5,027,460 | A | | 7/1991 | Honig | 5/497 |
| 5,042,098 | A | | 8/1991 | Stultz | 5/495 |
| 5,165,128 | A | | 11/1992 | Honig | 5/497 |
| 5,177,821 | A | | 1/1993 | Kawtoski | 5/497 |
| 5,189,744 | A | | 3/1993 | Roberts | 5/497 |
| 5,465,440 | A | | 11/1995 | Heptner | 5/497 |
| 5,515,799 | A | | 5/1996 | Heptner | 112/475.08 |
| 5,794,285 | A | | 8/1998 | Burch | 5/497 |
| 5,966,759 | A | * | 10/1999 | Sanders et al. | 5/499 |
| 6,041,456 | A | | 3/2000 | Pharr | 5/497 |
| 6,286,163 | B1 | | 9/2001 | Trimble | 5/485 |
| 6,393,640 | B1 | | 5/2002 | Dalis | 5/497 |
| 6,532,608 | B2 | | 3/2003 | Schreiner | 5/497 |
| 6,574,815 | B2 | * | 6/2003 | Freeman et al. | 5/716 |
| 6,725,477 | B2 | | 4/2004 | Ciaglia et al. | 5/497 |
| 7,100,525 | B1 | * | 9/2006 | Price et al. | 112/475.08 |
| 2002/0144352 | A1 | * | 10/2002 | Freeman et al. | 5/716 |
| 2003/0037374 | A1 | | 2/2003 | Ciaglia et al. | 5/497 |
| 2004/0031100 | A1 | | 2/2004 | Creech | 5/497 |
| 2004/0200000 | A1 | | 10/2004 | Harbin et al. | 5/497 |
| 2006/0253981 | A1 | * | 11/2006 | Hermanczuk | 5/497 |

* cited by examiner

*Primary Examiner*—Robert G. Santos
(74) *Attorney, Agent, or Firm*—Young Basile Hanlon MacFarlane & Helmholdt

(57) ABSTRACT

A fitted top sheet for a mattress includes a material blank having a pair of opposed fitted corners formed by at least one pleat on a blank surface of the sheet. A plurality of pleats may be formed in each corner to form a pocket mountable over a bottom corner of a mattress. The bottom edges of the fitted top sheet hang freely below the bottom edge of the mattress without tucking beneath the mattress to allow ample foot room between the top sheet and the mattress for a user's feet while without separating from the mattress during use of the bed.

5 Claims, 3 Drawing Sheets

FITTED TOP SHEET

BACKGROUND

The present invention relates, in general, to a top sheet for a bed mattress and, more particularly, to a fitted top sheet for a mattress.

Unfitted, flat bed sheets are widely used with a bed mattress. Such sheets, also known as top sheets, are spread flat over the upper surface of the mattress with the side and bottom edges typically hanging downward beyond the lower edge of the mattress. At least the bottom edge and usually the sides of the top sheet are tucked under the mattress between the mattress and the box springs to keep the top sheet in place on the mattress.

However, mattresses, particularly king and queen size mattresses, make it difficult to easily bend over and lift the bottom edge of the mattress a sufficient amount to enable the edges of the top sheet to be tucked underneath the mattress. This is especially troublesome and potentially injurious for individuals who make a large number of beds each day in hotels, hospitals, etc.

While the bottom sheets typically have elastic pockets formed at each corner to enable the bottom sheet to be fit over the mattress and held securely in place during use of the bed, elastic corners cannot be applied to all four corners of the top sheet since such would prevent an individual from pulling back the top sheet to enter the bed. In addition, the tight fit of the top sheet at the bottom edge of the bed due to the elastic corners provides limited space for the user's feet thereby making use of the bed uncomfortable. Elastic also has a tendency to lose its elasticity over time and repeated washings thereby rendering the sheet unusable or difficult to use despite the fact that the sheet material may still be in good condition.

Although the four elastic pockets on the bottom sheet are easily placed on the mattress to properly locate the bottom sheet on the mattress, unfitted top sheets pose a centering problem which causes the person making the bed to typically make several trips from one side of the bed to the other to make sure that the top sheet is substantially centered on the mattress with even amounts of overhang on both sides and a sufficient amount of overhang at the bottom edge for tucking and to hide the mattress.

Attempts have been made to address these problems by providing a fitted top sheet. However, most fitted top sheets still employ elastic at the fitted corners which engage the bottom corners of the mattress thereby not fully addressing the problems of an uncomfortable fit for the user's feet as well as the eventual loss of elasticity rendering the top sheet unusable. Other fitted top sheets employ a specially designed and shaped sheet with elaborate cut outs or notches which are folded together over the mattress to provide a pocket for the user's feet.

However, such fitted top sheets are easily dislodged due to the normal movements of a person during sleep which pulls the folded over, fitted edges of the sheet away from the mattress thereby requiring the top sheet to be recentered and retucked under the mattress after each time the bed is used.

Such elaborately folded top sheets also require extra steps to place the top sheet in the proper position on the mattress. This can be time consuming for those individuals who make up a large number of beds each day in hotels, hospitals, etc.

Thus, it would be desirable to provide a fitted top sheet for a bed mattress which addresses the problems of prior art top sheets with respect to the need to bend over and lift the edge of the mattress to tuck the top sheet under the mattress, repeated movements around the bed to center the top sheet on the mattress, the need to remount the top sheet to the mattress after each use since the top sheet is easily become separated from the mattress during bed use.

SUMMARY

A fitted top sheet mountable over a mattress is disclosed. The fitted top sheet includes a blank material having a top portion, opposed side portions, and an end portion. A width of the blank is greater than a width of a mattress on which the blank is mountable such that the edges of the side and end portions of the blank extend below a bottom edge of the mattress when the sheet is deployed on the mattress.

At least one pleat formed at each of the opposed ends of the bottom end portion of the blank. The pleat(s) forms opposed fitted corners mountable over the corresponding bottom corner edges of a mattress to fit the top sheet over the mattress.

In another aspect, the at least one pleat comprises a plurality of pleats, such as three pleats, for example. A central one of the pleats is substantially alignable with a center line of the bottom corner of the mattress. Additional side pleats are spaced equidistantly on opposite sides of the central pleat and extend substantially parallel to the central pleat.

Folded over portions of the pleats on the rear surface of the blank can be fixed to the hem of the blank.

The top sheet described herein overcomes many of the deficiencies encountered with the use of prior flat top sheets as well as fitted top sheets. Since there is no need to fold and tuck the bottom edges of the top sheet beneath the mattress, placing the fitted top sheet on the mattress is quicker, and involves less tiresome labor while still providing adequate foot room between the top sheet and the mattress. Further, the fitted corners remain in place on the mattress between uses thereby eliminating the need to reposition the top sheet and retuck the corners of the top sheet beneath the mattress after each use.

A properly folded fitted top sheet can be quickly and easily centered and located on a mattress and then unfolded to drop into position over the top of the mattress in a simple, quick, and expeditious manner.

BRIEF DESCRIPTION OF THE DRAWING

The various features, advantages and other uses of the present invention will become more apparent by referring to the following detailed description and drawing in which.

DETAILED DESCRIPTION

Figure 1:
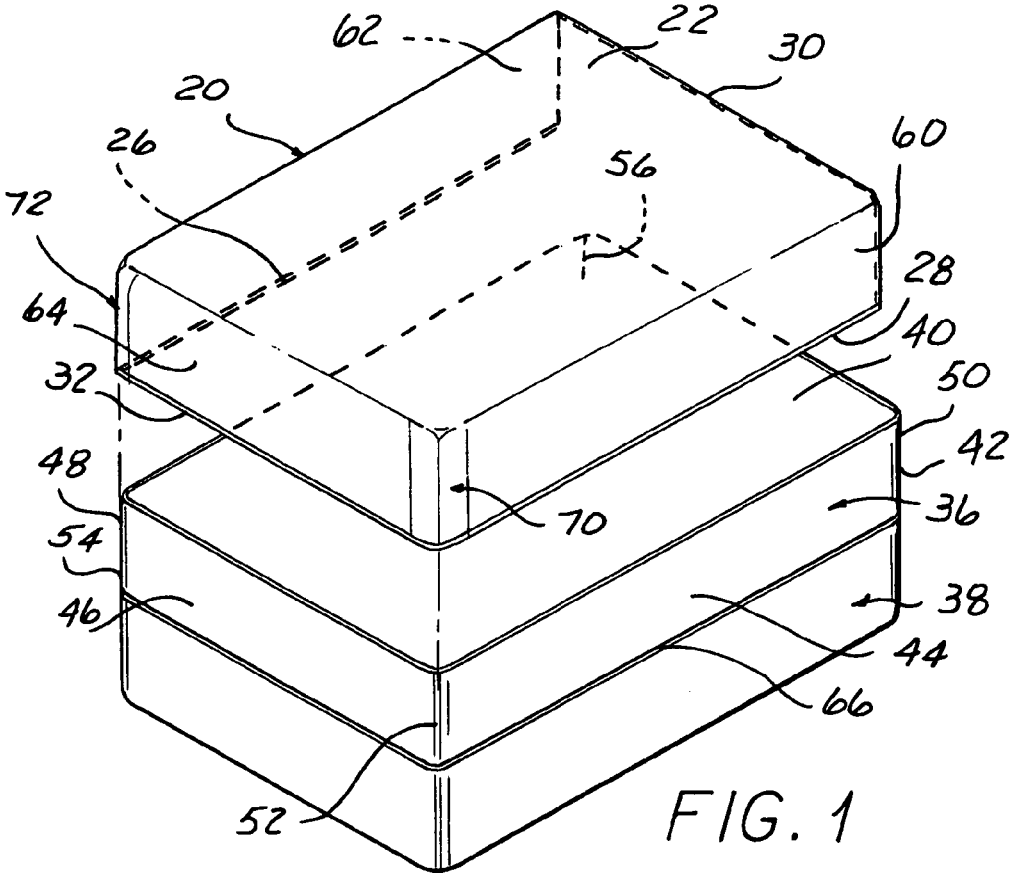
FIG. 1 is an exploded perspective view of a fitted top sheet mounted over a bed mattress.

Referring now to FIGS. 1-9 of the drawing, there is depicted a fitted top sheet 20 which provides many advantages in making and using a bed in residential, institutional, or commercial settings.

The fitted top sheet 20 is formed of a blank of fabrics and materials commonly found in bed sheets made today. Such materials may include cotton, silk, synthetic materials and combinations thereof, by way of example only.

The fitted top sheet 20 is typically provided with a four-sided polygonal shape. Typically, the top sheet 20 has a rectangular shape; although larger size sheets, such as king size sheets, may be almost square in shape. It will be understood that the fitted top sheet 20 described herein may be provided in any size, for different size mattresses, such as twin, queen, king, etc.

Figure 3:
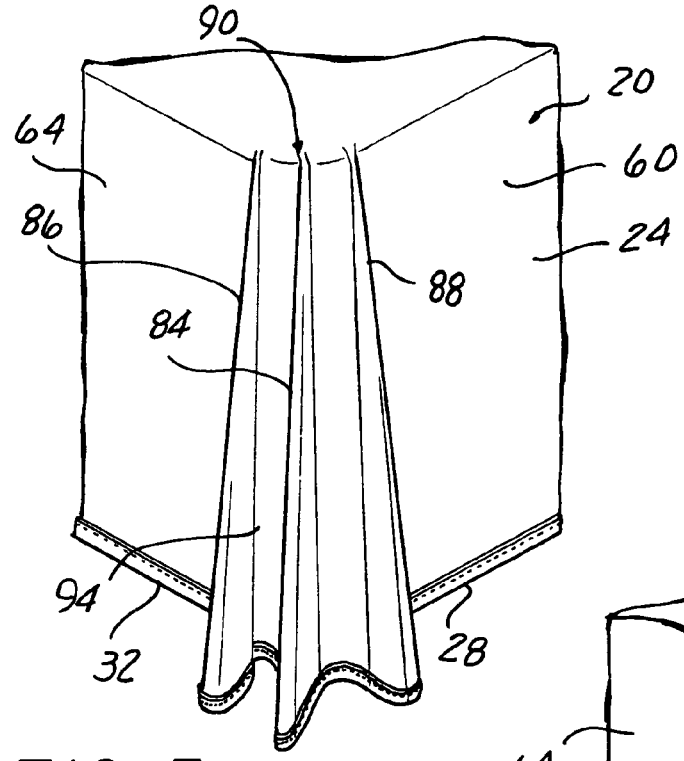
FIG. 3 is a partial, enlarged perspective view showing the rear surface of the top sheet during an initial construction step.

Thus, regardless of the overall size or shape of the top sheet 20, the top sheet 20 has, taken from a view from the top of a mattress, a top surface 22, a rear or back surface 24, shown in FIG. 3, opposed side edges 26 and 28, a top edge 30, and a bottom edge 32. As is typical, the side edges 26 and 28, the top edge 30, and the bottom edge 32 may be hemmed to provide a neat appearance and to prevent unraveling.

The top sheet 20 is designed for application over a bed mattress 36 which, in typical use, rests on a box spring 38 which is supported in a frame, not shown. The mattress 36, which again can be provided in any typical mattress size or even a custom size, has a top surface 40, an opposed bottom surface, not shown, and four identical height sides, such as sides 42, 44, 46, and 48. The sides 42, 44, 46, and 48 are separated by corners, such as corners 50, 52, 54, and 56.

The top sheet 20 has a length, which may be a standard size sheet length for any of a twin, queen, or king size mattress, such that the top edge 30, when the top sheet 20 is applied to the mattress 36, is located on the top surface 40 of the mattress 36 adjacent to, but typically spaced from a top edge of the mattress 36.

The top sheet 20 has a width and length such that when the top sheet 20 is applied over the mattress 36, two opposed side panels 60 and 62, as well as a bottom panel 64, which are respectively located adjacent to the side edges 54 and the bottom edge 46 of the mattress 36, have the same height and, by example only, overhang from the top surface 40 of the mattress 36 the same distance or height as the height of the side edges 42, 44, 46, and 48 of the mattress 36 on which the top sheet 20 is mounted. This places the bottom edges 26, 28, and 32 of the top sheet 20 at least substantially in line with a bottom edge 66 of the mattress 36. It will be understood that the width and length of the sheet 20 may be modified to different widths and lengths so as to vary the amount of the overhang of the side panels 60 and 62 and the bottom panel 64 of the top sheet 20 over the side edges 44, 46, and 48 of the mattress 36.

This amount of overhang eliminates the need to tuck in the bottom edges 26, 28, and 32 of the top sheet 20 beneath the bottom edge 66 of the mattress 36 between the mattress 36 and the box spring 38. In addition, the overhang of the side panels 60 and 62 and the bottom panel 64 over the respective side and bottom edges 44, 48, and 46 of the mattress 36 enables the top surface 22 of the top sheet 20 to be elevated away from the top surface 40 of the mattress 36 to enable a user to easily enter and get out of the bed, move around on the mattress 36 during sleep, as well as to be elevated to provide a comfortable space for the user's feet. These functions are provided without causing the bottom panel 64 or any portion of the side panels 60 and 62 from being completely separated from the mattress 36.

A pair of fitted corners 70 and 72 are formed on the sheet 20 at locations corresponding to the bottom side edges 52 and 54 of the mattress 36. As shown in FIG. 3, at least one, with two or more pleats such as three pleats 84, 86, and 88 shown by way of example only, are formed on the back surface 24 of the sheet 20. The pleats 84, 86, and 88 extend for a predetermined length tailored to the thickness of mattress from the hem or bottom edges 28 and 32 of the sheet 20 for the total height of the mattress 36 plus the predetermined additional amount, such as four inches of sheet overhang, by way of example only. As shown in FIG. 3, the pleats 84, 86, and 88 extend from an upper end 90 to an opposed lower end at the hem on the bottom edge of the sheet 20.

The pleats 84, 86, and 88, as shown in FIG. 3, are formed with a generally V-shaped fold in the sheet 20. The distance between the fold and the apex of each pleat 84, 86, and 88 varies in length between the top of each peat 84, 86, and 88 and the bottom of each pleat 84, 86, and 88.

For odd numbers of pleats, such as 1, 3, 5, etc., one pleat is positioned such that the creased or folded edge of the sheet is substantially alignable with a center line of the bottom corner of the mattress 36. When even numbers of pleats are used in the top sheet 20, the innermost pair of spaced pleats are spaced substantially equidistantly from the bottom corner edge of the mattress 36 when the sheet 20 is deployed on the mattress 36.

The centralmost pleat 84 extends at a slight angle from perpendicular from the top edge 90 from the corner of the sheet 20. The side pleats 86 and 88 are spaced equidistantly on opposite sides of the central pleat 84 and are generally parallel to the pleat 84.

The innermost fold edge, such as edge 94 of each pleat 84, 86, and 88, can be stitched so as to retain the shape of the pleats 84, 86, and 88 or merely pressed to form a crease in each pleat at the juncture of each pleat and the side panels 24, 26, and the bottom edge 64 of the sheet 20.

The formation of each pleat 84, 86, and 88 forms a generally tapered flounce extending from the upper end 90 to a larger dimension at the hem.

Figure 4:
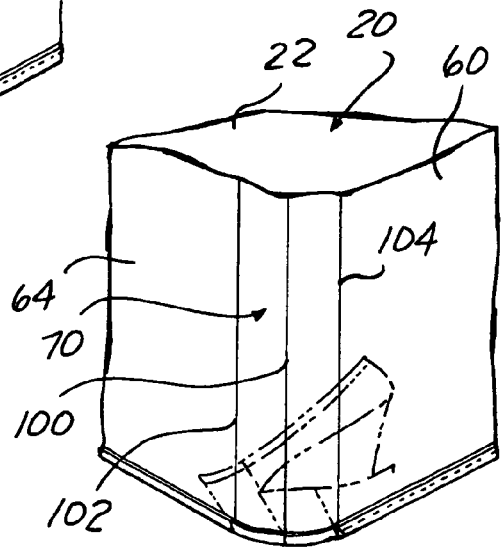
FIG. 4 is a partial, enlarged, perspective view of the top sheet of FIG. 3 in a subsequent construction step.

As shown in FIG. 4, the pleats 84, 86, and 88 are folded over the side panels 60 and 64 of the sheet 20. The bottommost edges adjacent the hem are folded upward as shown in FIG. 4 to overlay the remainder of the pleats 84, 86, and 88 or cut in a line generally co-linear with the hem of the sheet 20. Pinking shears may be used to cut the excess material from each pleat 84, 86, and 88.

The ends of each pleat 84, 86, and 88 may optionally stitched to the hem of the sheet 20 or merely left in a folded position on the back surface 24 of the sheet 20. Alternately, the pleats 84, 86, and 88 may be left unfolded as shown in FIG. 3 for a decorative effect.

Figure 2:
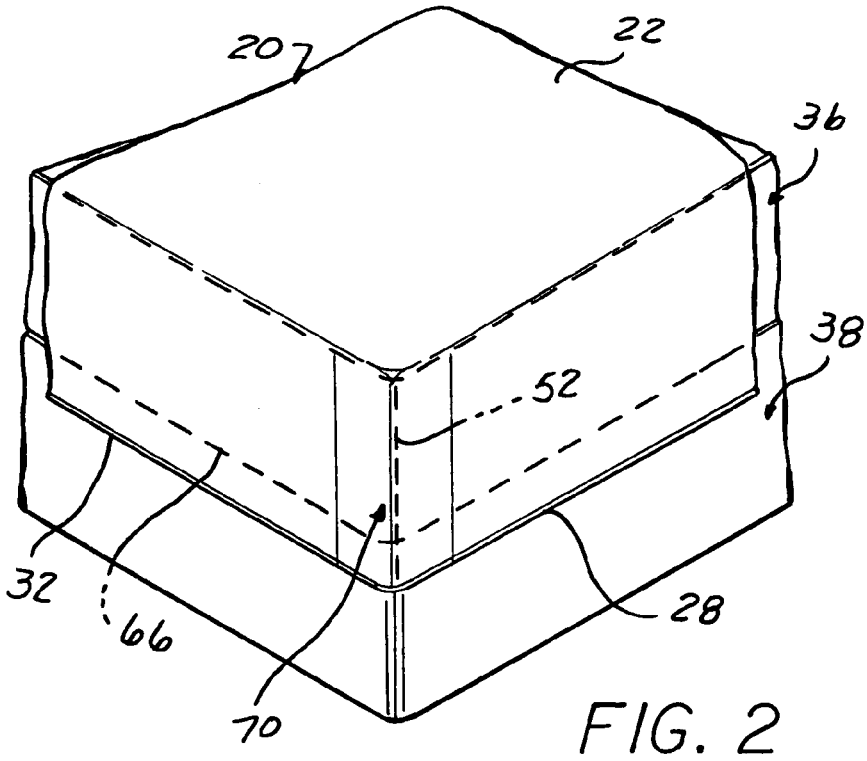
FIG. 2 is an enlarged showing the mounting of one edge of the fitted top sheet of FIG. 1 on the mattress.

When the pleats 84, 86, and 88 have been completed, the sheet 20 is reversed so that the top surface 22 is outermost and the folded over portions of the pleats 84, 86, and 88 are disposed in an overlying relationship with the back surface 24 of the sheet 20. The stitched ends of the pleats 84, 86, and 88 form three generally parallel pleat lines 100, 102, and 104 on the top surface 22 on the sheet 20 as shown in FIG. 4. The central pleat line 100 is adapted to be disposed substantially over the edge 52 of the mattress 36. The two side pleat lines 102 and 104 are spaced on opposite sides, generally equidistantly from the central pleat line 100. This pleat arrangement forms a fitted corner at each of the bottom edges or corners of the sheet 20 as shown in FIGS. 1 and 2.

When the top sheet 20 is installed over the mattress 36, the bottom edges 28, 32, etc., extend a predetermined distance, such as four inches for example, below the bottom edges 66 of the mattress. The amount of overhang can vary depending on the thickness of the mattress 36. Meanwhile, the fitted corner 70 and 72 fits snuggly over the bottom edges 52 and 54 of the mattress 36 to position the top sheet 20 on the mattress 36. At the same time, the loose, untucked, non side-to-side movable hanging of the lower edges of the sheet 20 in line or below the bottom edge 66 of the mattress 36, allows the bottom portion of the top sheet 20 to rise upward away from the top surface 40 of the mattress 36 to allow comfortable room for the user's feet.

Further, the fitted corners 70 and 72 allow the top sheet 20 to be quickly centered on the mattress 36 thereby eliminating the tiresome and time consuming necessity of walking back and forth between the opposite sides of the bed to properly center a top sheet on the mattress.

Referring now to FIGS. 5-9, there is depicted a unique method of installing the fitted top sheet 20 on a mattress 36.

Figure 5:
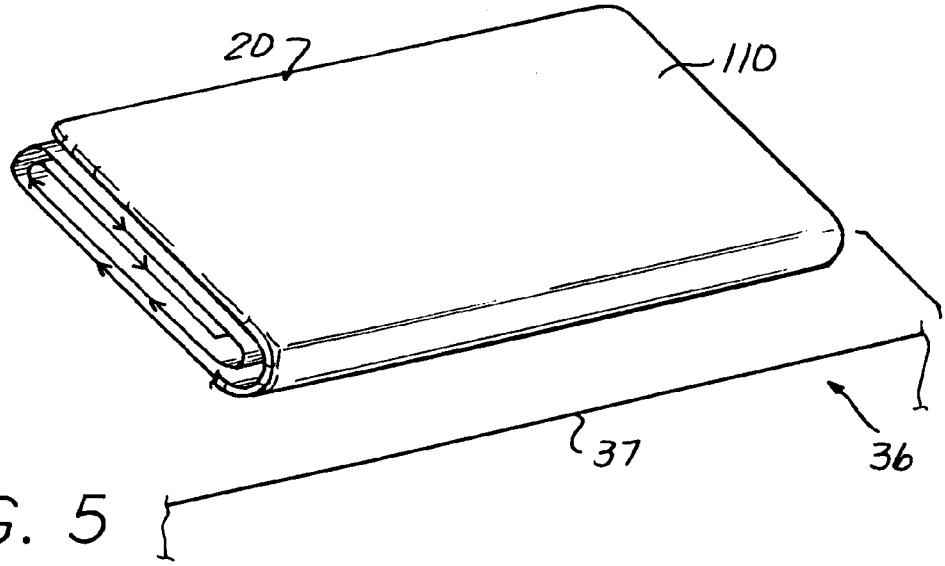
FIGS. 5-9 are perspective views showing the sequential steps in applying the fitted top sheet of FIGS. 1-4 on a mattress.
Figure 6:
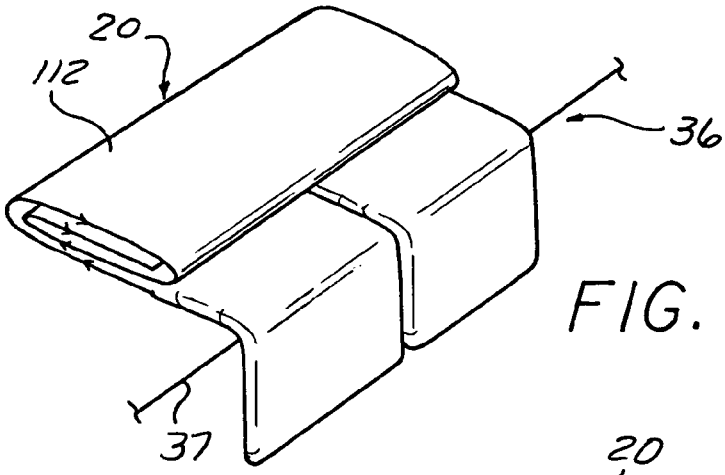

As shown in FIG. 5, the fitted top sheet 20, folded up as described hereafter, is positioned adjacent the top bottom edge 37 of the mattress 36. The outermost fold 110 of the folded up top sheet 20 is then unwrapped from the stack and draped over the top bottom edge 37 of the mattress 36 as shown in FIG. 6. The remaining folds denoted by reference number 112 are then longitudinally unwound toward the top of the mattress 36 to the position shown in FIG. 7. The two longitudinal folds 114 and 116 are then each unwrapped laterally over the top surface 40 of the mattress 36 until the side edges 26 and 28 naturally hang downward from the top surface 40 of the mattress 36 to a bottom edge located in line or up to four or more inches below the bottom edge 66 of the mattress 36.

This quickly completes the installation of the fitted top sheet 20 on a mattress 36 in a less time consuming manner than required with previously devised fitted sheets or unfitted, flat top sheets.

Figure 7:
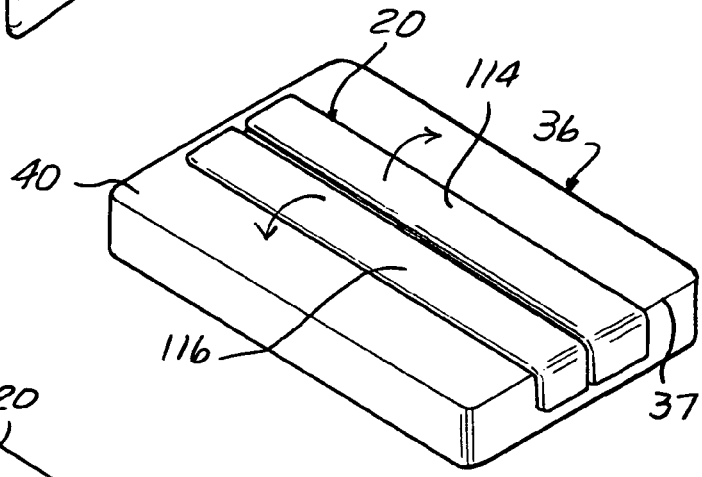
Figure 8:
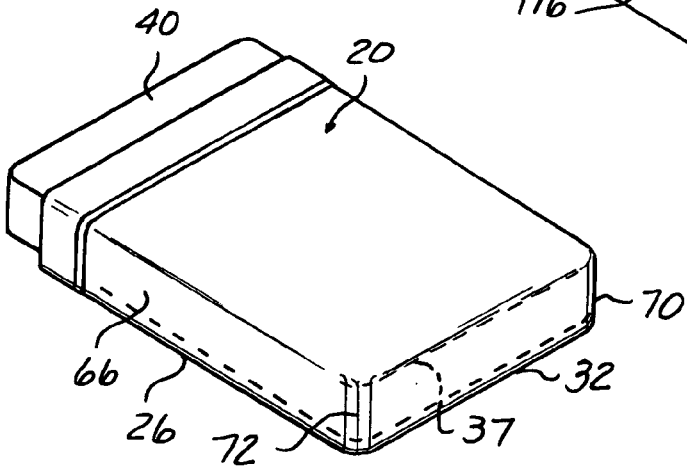
Figure 9:
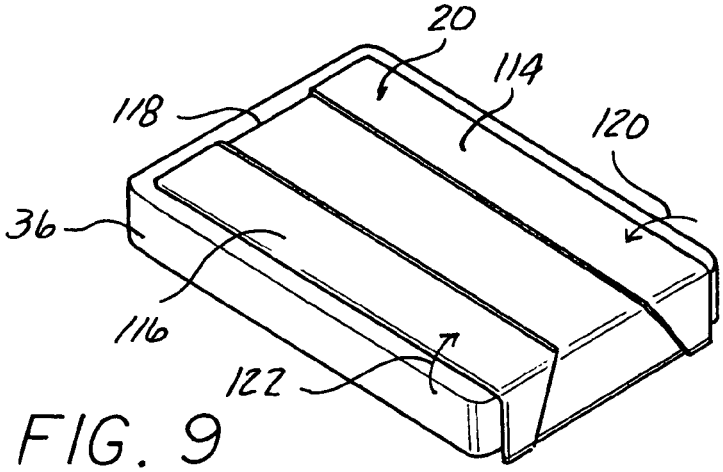

After the fitted top sheet 20 has been laundered, it can be spread out on a flat surface or on a mattress 36 as shown in FIG. 9. The lateral sides are then folded inward as shown by the arrows 120 and 122 to form the longitudinal folds 116 and 114. Starting from the top edge 118 of the top sheet 20, after the lateral folds 114 and 116 are substantially touching as shown in FIG. 7, the top sheet 20 is folded longitudinally on itself until it reaches the position shown in FIG. 6. The bottom portion of the fitted top sheet hanging over the top edge 37 of the mattress 36 is then folded over the top of the stack to return the folded up top sheet 20 to the ready to install position shown in FIG. 5.

In summary, there has been disclosed a unique fitted top sheet which addresses the deficiencies with previously devised flat top sheets and even fitted top sheets. The fitted top sheet is easily and quickly centered and mounted on a mattress through the use of pleated fitted corners. The lack of the elastic to form the corners extends the useful life of the fitted top sheet.

Further, since the bottom edges of the fitted top sheet hang loosely in a non-tucked manner in line with or below the bottom edge of the mattress, the time and effort previously required to tuck the bottom edges of a top sheet underneath a mattress is eliminated. The free floating of the bottom edges of the top sheet over the mattress provides a comfortable space for a user's feet during sleep as well as enabling the user to easily enter and exit the bed.

What is claimed is:

1. A fitted top sheet for use on a mattress having an end with spaced corner edges and a predetermined height, the top sheet comprising:

a material blank having a top portion, opposed side portions, and an end portion defining a first surface therebetween adapted to face away from a mattress when the fitted top sheet is deployed over a mattress an opposed second surface adapted to face toward a mattress, a width of the blank being greater than a width of a mattress on which the blank is mountable such that the edges of the side portions and end portions of the blank freely extend at least in line with a bottom edge of the mattress when the blank is deployed on the mattress; and at least two generally vertically oriented and spaced pleats formed at each of the opposed ends of the end portion of the blank between the top portion and the bottom edge of the blank and overlaying the second surface of the sheet, the pleats spaced apart along an entire length of each pleat and forming opposed fitted corners mountable over the corresponding bottom corner edges of a mattress to fit the top sheet on the mattress without the side and end portions being tucked under the mattress.

2. The fitted top sheet of claim 1 wherein the at least pleats comprise at least three pleats.

3. The fitted top sheet of claim 2 wherein a first one of the pleats is substantially aligned with a centerline of a bottom corner of the mattress.

4. The fitted top sheet of claim 1 wherein an edge of a folded over portion of the least two pleats is substantially parallel to the bottom edges of the blank.

5. A fitted top sheet for use on a mattress having an end with spaced corner edges and a predetermined height, the top sheet comprising:

a material blank having a top portion, opposed side portions, and an end portion, a width of the blank being greater than a width of a mattress on which the blank is mountable such that the edges of the side portions and end portions of the blank extend at least in line width a bottom edge of the mattress when the blank is deployed on the mattress;

a plurality of pleats formed at each of the opposed ends of the end portion of the blank between the top portion and the bottom edge of the blank, the pleats forming opposed fitted corners mountable over the corresponding bottom corner edges of a mattress to fit the top sheet over the mattress;

a first one of the pleats is substantially aligned with a centerline of a bottom corner of the mattress; and at least two additional pleats spaced substantially equidistantly and parallel to the first one of the pleats on opposite sides of the first one pleat.

* * * * *